US006896076B2

(12) United States Patent
Nelson et al.

(10) Patent No.: US 6,896,076 B2
(45) Date of Patent: May 24, 2005

(54) ROTATING DRILLING HEAD GRIPPER

(75) Inventors: John E. Nelson, Houston, TX (US); Charles B. Smith, Houston, TX (US); Ready J. Johnson, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/308,701

(22) Filed: Dec. 3, 2002

(65) Prior Publication Data

US 2003/0102136 A1 Jun. 5, 2003

Related U.S. Application Data

(60) Provisional application No. 60/336,757, filed on Dec. 4, 2001.

(51) Int. Cl.[7] ..... E21B 33/02

(52) U.S. Cl. ..... 175/57; 166/84.3; 166/84.4; 175/195; 251/1.2; 277/326

(58) Field of Search ..... 175/57, 195; 166/85.4, 166/84.4, 84.3, 379; 277/326, 332, 334; 251/1.2

(56) References Cited

U.S. PATENT DOCUMENTS

| | | | | | |
|---|---|---|---|---|---|
| 2,862,735 | A | | 12/1958 | Knox | |
| 2,945,665 | A | * | 7/1960 | Regan et al. | 277/332 |
| 3,614,111 | A | * | 10/1971 | Regan | 251/1.2 |
| 3,621,912 | A | * | 11/1971 | Wooddy et al. | 166/340 |
| 4,358,085 | A | * | 11/1982 | Regan et al. | 251/1.2 |
| 4,441,551 | A | | 4/1984 | Biffle | |
| 4,480,703 | A | | 11/1984 | Garrett | |
| 4,486,025 | A | | 12/1984 | Johnston | |
| 4,500,094 | A | | 2/1985 | Biffle | |
| 4,658,894 | A | | 4/1987 | Craig | |
| 4,971,148 | A | * | 11/1990 | Roche et al. | 166/88.1 |
| 5,178,215 | A | | 1/1993 | Yenulis et al. | |
| 5,588,491 | A | | 12/1996 | Brugman et al. | |
| 5,647,444 | A | | 7/1997 | Williams | |
| 5,901,964 | A | | 5/1999 | Williams et al. | |
| 6,016,880 | A | | 1/2000 | Hall et al. | |
| 6,109,348 | A | | 8/2000 | Caraway | |
| 6,129,152 | A | | 10/2000 | Hosie et al. | |
| 6,244,359 | B1 | | 6/2001 | Bridges et al. | |
| 6,554,016 | B2 | * | 4/2003 | Kinder | 137/12 |

* cited by examiner

*Primary Examiner*—Hoang Dang
(74) *Attorney, Agent, or Firm*—Bracewell & Patterson, L.L.P.

(57) ABSTRACT

A rotating drilling head seals around drill pipe while drilling. The drilling head has an outer housing that mounts to the rig floor. An inner housing is rotatably mounted in the outer housing. An annular bladder is mounted in the inner housing. An annular elastomeric gripping member is mounted in the bladder. The inner housing having a passage for delivering hydraulic fluid pressure to the outer surface of the bladder to cause the bladder to deform inwardly, thereby forcing the gripping member to deform inwardly to grip and rotate with a drill pipe. The gripping member has a first end secured to the inner housing for rotating the inner housing as the drill pipe rotates and a second end that is free to move axially to allow the bladder to elongate in response to the deformation by the bladder.

8 Claims, 5 Drawing Sheets

ROTATING DRILLING HEAD GRIPPER

CROSS-REFERENCE TO RELATED APPLICATIONS

This application claims the priority of U.S. Provisional patent application Ser. No. 60/336,757 filed Dec. 4, 2001.

BACKGROUND OF THE INVENTION

1. Field of the Invention

The present invention relates generally to rotating drilling head systems in which an elastomer seals around and grips a rotating drill pipe during drilling operations.

2. Description of the Related Art

Oil and gas wells are typically drilled by use of a rotating drill pipe with a drill bit at the lower end. Drilling fluids are pumped down the drill pipe and out the drill bit. The drilling fluid returns to the surface, along with cuttings, through the annulus around the drill pipe. In many cases, the pressure at the upper end of the drill pipe annulus is atmospheric. The weight of the drilling fluid is controlled to provide a hydrostatic pressure at the earth formations that is greater than the formation pressure to prevent blowouts.

In some cases, however, it is advantageous to isolate the pressure at the upper end of the column from atmospheric pressure. For example, in highly deviated well, a lightweight drilling fluid may be used that is not heavy enough to prevent upward flow in the well due to formation pressure. A drilling head at the upper end of the well controls the pressure. Drilling head systems use an elastomeric element to seal the drilling head against the rotating drill pipe during drilling operations. In some rotating drilling head systems, the seal is formed by the natural resiliency of the elastomeric element against the drill pipe while others use hydraulic pressure to deform the seal element. In U.S. Pat. No. 6,016,880, hydraulic pressure is applied to a bladder that surrounds an elastomeric gripper element that is located above an elastomeric primary seal. The bladder forces the gripper inward to grip the drill pipe to cause the gripper and primary seal to rotate with the drill pipe. The gripper also serves as a secondary seal in the event of leakage of the primary seal. Furthermore, the gripper has to continue gripping and sealing around the drill pipe as it moves downward while drilling. The tool joints at the end of each drill pipe are larger in diameter than the drill pipe and must pass through the gripper while it continues to seal and grip the drill pipe.

While the system of the '880 patent is workable, improvements in the gripper are desirable. As the bladder forces the gripper element inward, the gripper deforms, but does not compress. The deformation results in high stress and strain.

SUMMARY OF THE INVENTION

The rotating drilling head of this invention has an outer housing that is stationarily mounted above the well. An inner housing is rotatably mounted in the outer housing. An annular bladder is mounted in the inner housing. An annular resilient member is mounted in the bladder. The inner housing has a passage for delivering hydraulic fluid pressure to an outer surface of the bladder to cause the bladder to deform inwardly, thereby forcing the resilient member to deform inwardly to grip and rotate with a drill pipe. The resilient member has a first end secured to the inner housing for rotating the inner housing as the drill pipe rotates and a second end that is free to move axially in response to the deformation against the drill pipe. The deformation results in the resilient member elongating, reducing stress and strain.

Preferably, the resilient member is elastomeric and has at least one rigid reinforcing ring imbedded within it. Also, preferably, the bladder has rigid seal rings at its upper and lower ends. The seal rings contain seals that slidingly engage an inner wall of the inner housing. The seal rings allow the bladder to contract in length when pressurized.

BRIEF DESCRIPTION OF THE DRAWINGS

So that the manner in which the described features, advantages and objects of the invention, as well as others which will become apparent, are attained and can be understood in detail, more particular description of the invention may be had by reference to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

In the Drawings.

DETAILED DESCRIPTION

Figure 1A:
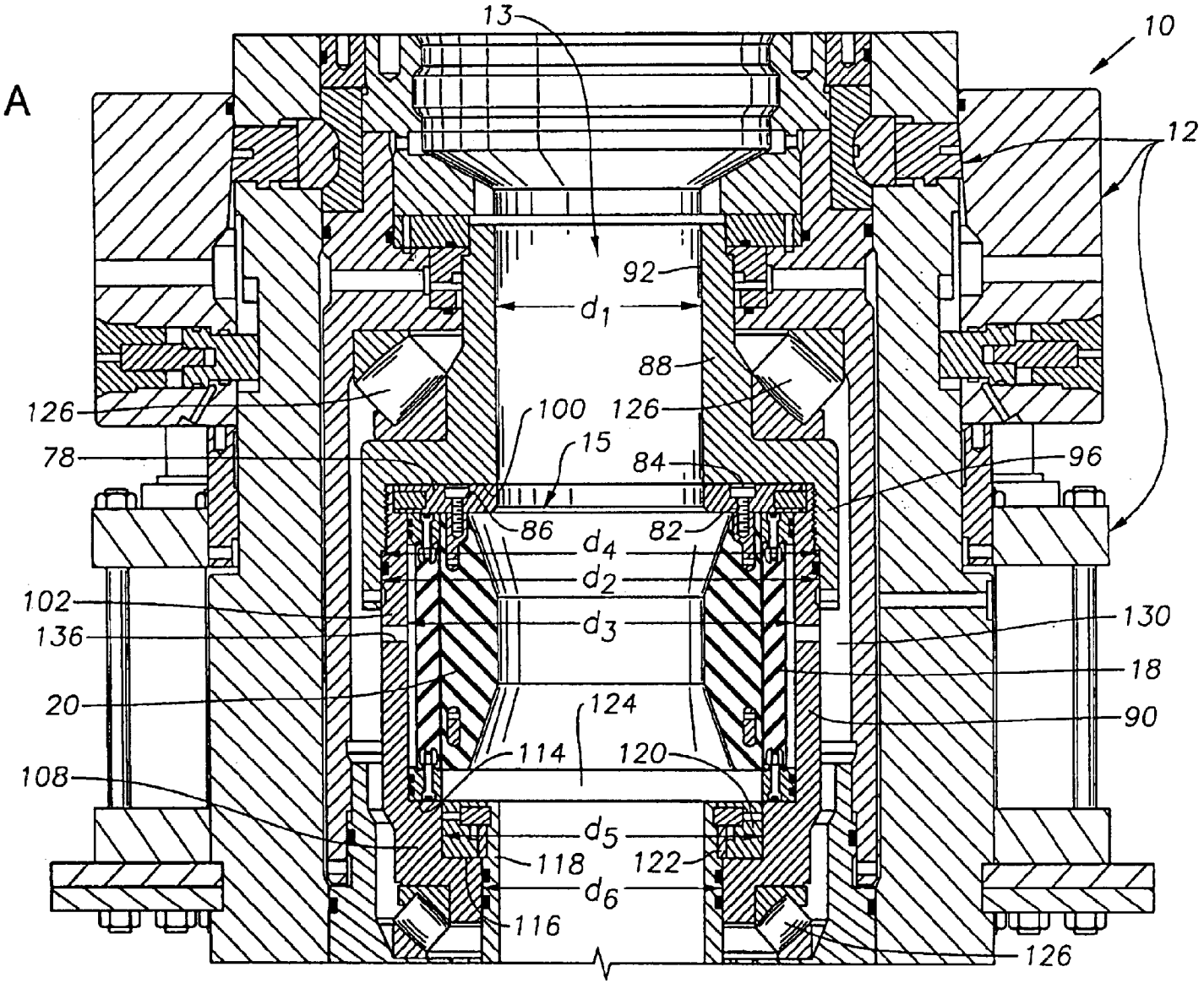
FIG. 1A is a sectional view of an upper portion of a rotating drilling system subassembly having a rotating drilling gripper constructed in accordance with the present invention.
Figure 1B:
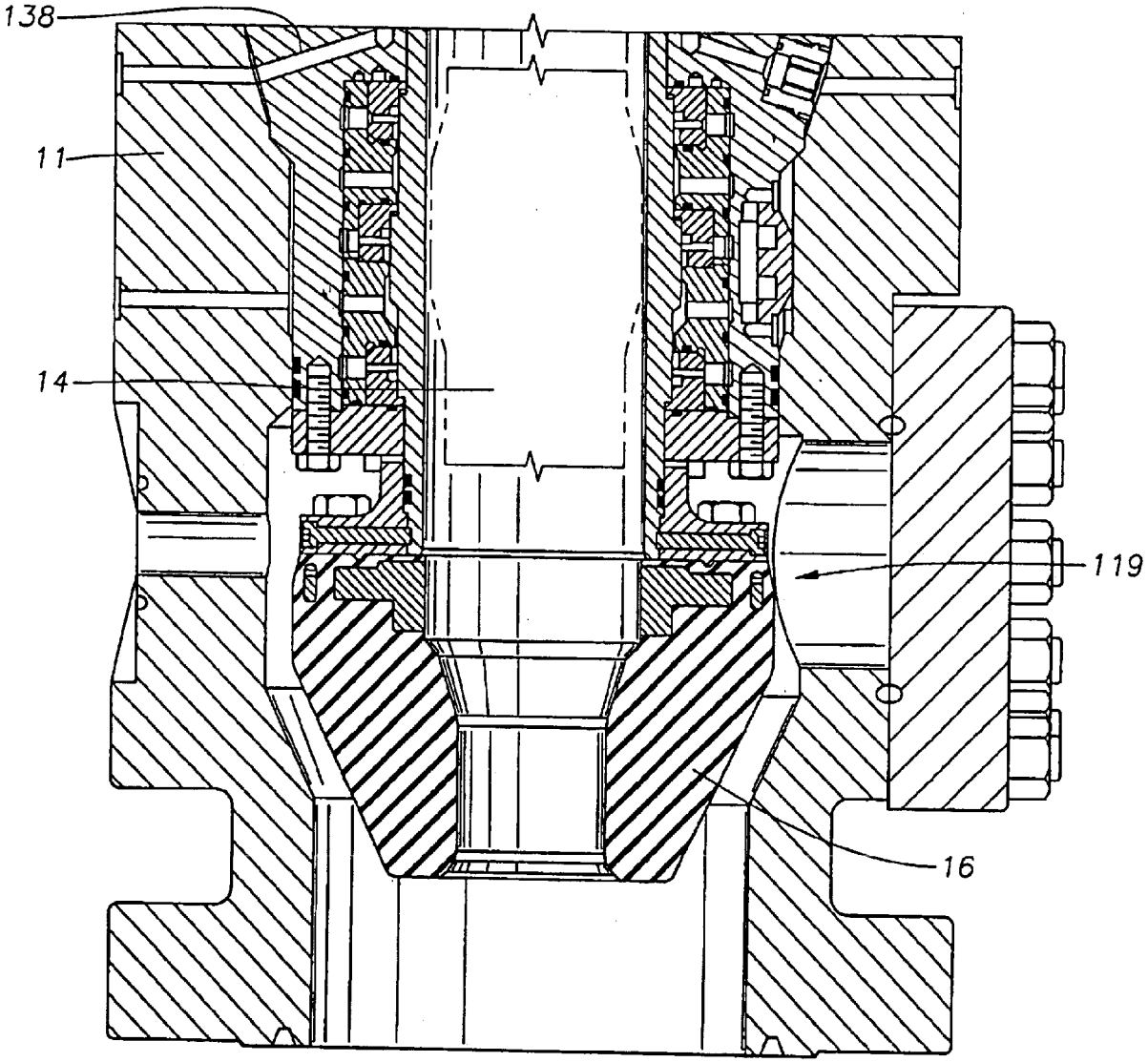
FIG. 1B is a sectional view of a lower portion of the rotating drilling system subassembly of FIG. 1A.

FIGS. 1A and 1B show a drilling system subassembly 10 comprising a stationary structure 11, a latch mechanism 12, and a rotating cartridge subassembly 13. Rotating cartridge assembly 13 has a rotating drilling gripper 15 constructed in accordance with the present invention. Gripper 15 is used in drilling operations and is typically installed as part of drilling system subassembly 10. Gripper 15 generally rotates with cartridge assembly 13, but the present invention would permit a rotational connection between them. In the embodiment of FIG. 1A, drilling system subassembly 10 is generally located very near the drilling rig floor. A primary function of gripper 15 is to grip a drillstring 14 extending axially through the centers of drilling system subassembly 10 and gripper 15 with a variable, controllable gripping force such that gripper 15 can rotate with drillstring 14 and allow drillstring 14 to move up or down in the axial direction, regardless of the rotation of drillstring 14. Another function of gripper 15 is to form a secondary or emergency seal to prohibit further upward travel of drilling fluid should it leak past the primary seal or stripper 16.

Figure 2:
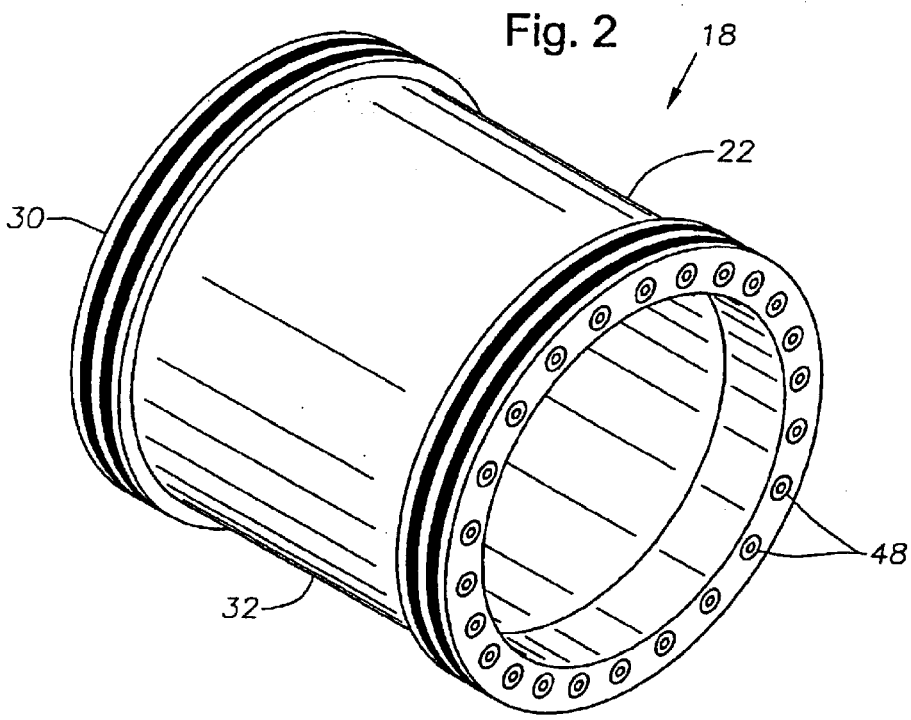
FIG. 2 is an orthogonal view of the bladder assembly of the rotating drilling gripper of FIG. 1A.
Figure 3:
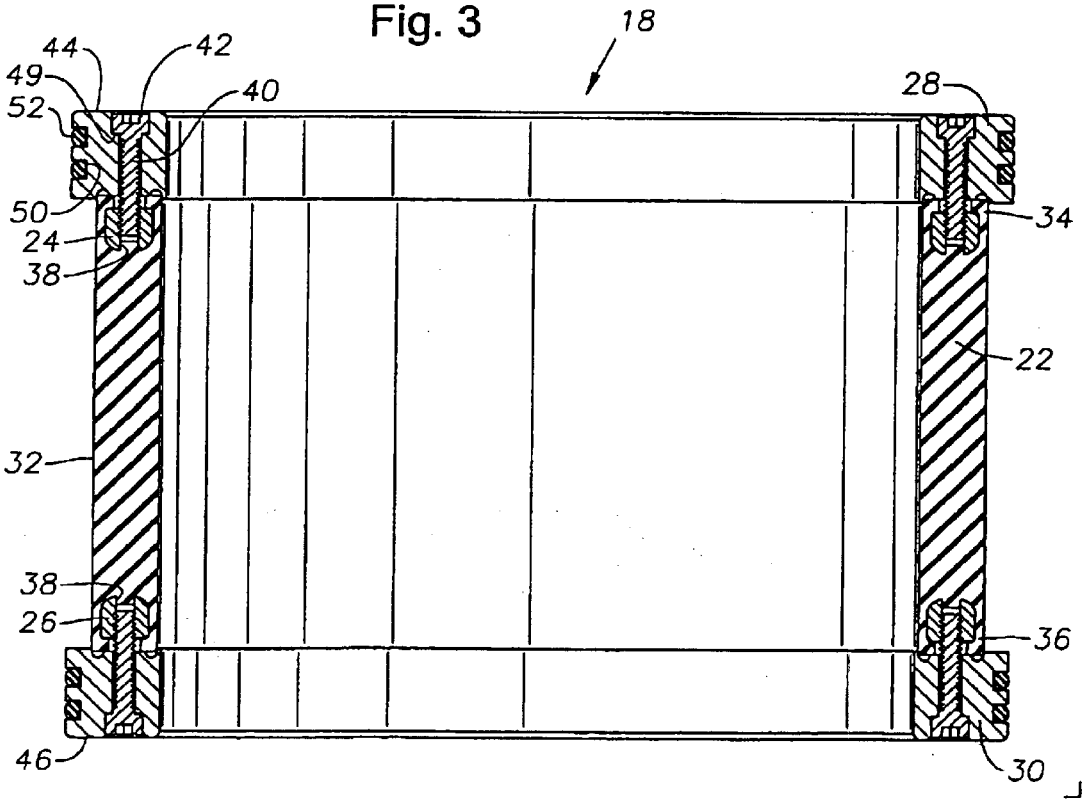
FIG. 3 is an enlarged sectional view of the bladder assembly of the rotating drilling gripper of FIG. 1A.

Gripper 15 comprises a bladder assembly 18 and a resilient member referred to herein as a gripper body assembly 20. FIGS. 2 and 3 show bladder assembly 18 corresponding to the embodiment of gripper 15 in FIG. 1A. Bladder assembly 18 is an open, right circular cylinder comprising a bladder 22, upper and lower reinforcement rings 24, 26, and upper and lower retention rings 28, 30. Bladder 22 forms the cylindrical wall 32 of bladder assembly 18, has upper and lower ends 34, 36, respectively, and is preferably made from a flexible elastomer such as urethane or treated natural rubber.

Rigid reinforcement rings 24, 26 are molded with and integral to ends 34, 36, respectively, of bladder 22 and provide structural rigidity to ends 34, 36. Thus, the nominal diameter of bladder 22 remains essentially constant in the vicinity of reinforcement rings 24, 26, though the diameter may vary along other, more flexible portions of bladder 22. Reinforcement rings 24, 26 preferably have internally threaded holes 38 by which retention rings 28, 30 are attached to ends 34, 36 respectively, of bladder 22 using mating, externally threaded bolts 40 having hex-socket caps 42.

Retention rings 28, 30 form upper and lower limits, respectively, of bladder assembly 18, and attach to bladder 22 in coaxial alignment with bladder 22. The uppermost surface 44 of upper retention ring 28 and the lowermost surface 46 of lower retention ring 30 each have circularly distributed countersink holes 48. Countersink holes 48 extend through the entire thicknesses of retention rings 28, 30, allowing each bolt 40 to pass freely therethrough and engage the threads of corresponding hole 38. Bolts 40 screw freely into holes 38 until caps 42 engage shoulders 49 of countersink holes 48. Further tightening of the threaded connection pulls retention rings 28, 30 and bladder 22 into secure abutment, creating a metal to elastomer seal.

Retention rings 28, 30 have inner diameters slightly smaller than the nominal inner diameter of bladder 22 in the vicinity of reinforcement rings 24, 26 and the outer diameters of retention rings 28, 30 slightly exceed the nominal outer diameter of bladder 22 in the vicinity of reinforcement rings 24, 26. Seats 50 are inset into the outermost cylindrical surface of retention rings 28, 30. Each retention ring 28, 30 has a pair of seats 50. Seats 50 each carry elastomer seals 52.

Retention rings 28, 30 and bladder 22 are sized such that the sum of their lengths in the axial direction equals a desired length, discussed in more detail below. The lengths of bolts 40 and depths of holes 38 in reinforcement rings 24, 26 are also carefully sized so that the caps 42 of bolts 40, which are countersunk into countersink holes 48, fit flush with or below the uppermost surface 44 or flush with and above lowermost surface 46.

Figure 4:
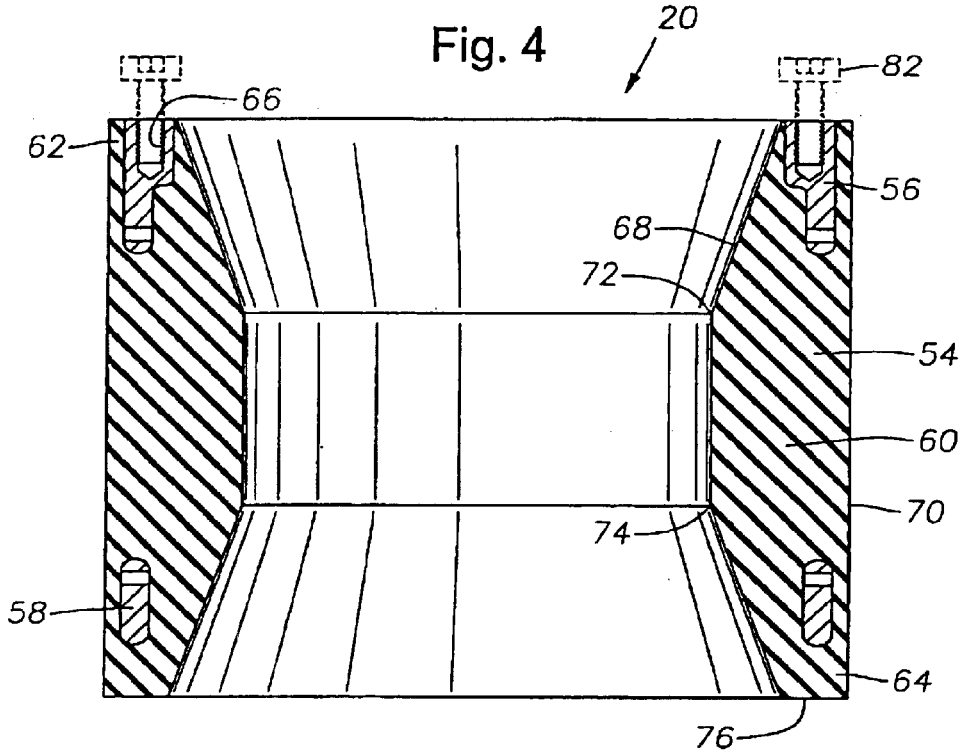
FIG. 4 is an enlarged sectional view of the gripper assembly of the rotating drilling gripper of FIG. 1A.
Figure 5:
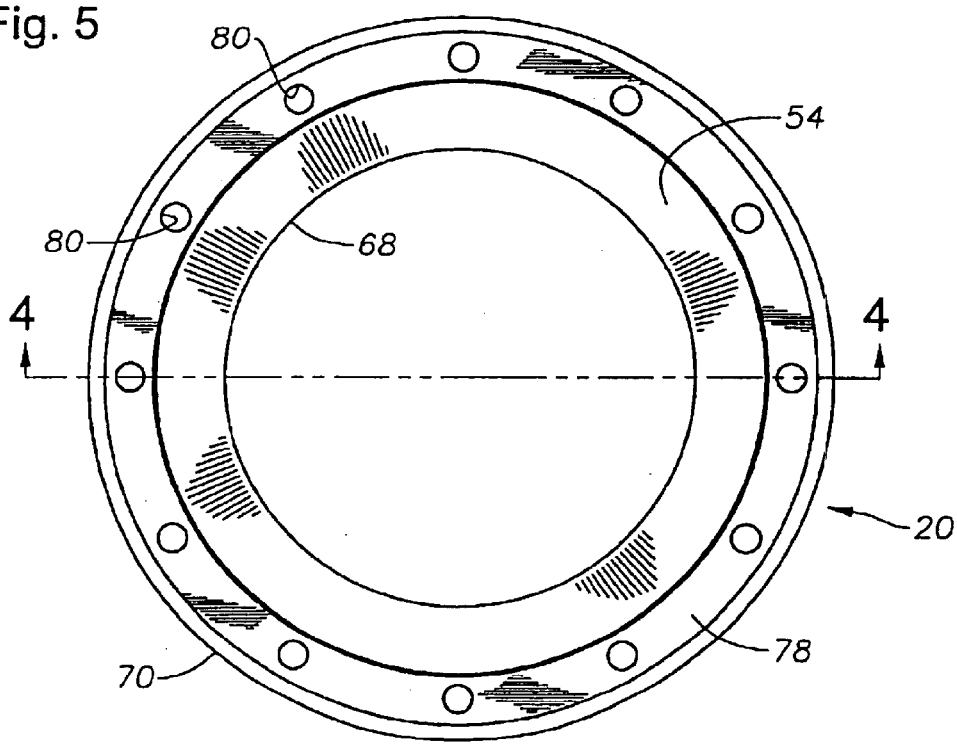
FIG. 5 is a plan view of the gripper assembly of the rotating drilling gripper of FIG. 1A.

FIGS. 4 and 5 show gripper body assembly 20 is also an open, right circular cylinder. Gripper body assembly 20 comprises a gripper element 54 and upper and lower support or reinforcing rings 56, 58. Gripper element 54 forms the cylindrical wall 60 of gripper body assembly 20, has upper and lower ends 62, 64, respectively, and is preferably made from a flexible, durable elastomer such as urethane or treated natural rubber. The elastomer used to form gripper element 54 is generally harder than the elastomer used to form bladder 22.

Rigid support rings 56, 58 are molded into ends 62, 64, respectively, of gripper element 54. Upper support ring 56 is embedded in, but its upper surface is preferably flush with, uppermost part of end 62. Upper support ring 56 has internally threaded holes 66 similar to holes 38 of reinforcement rings 24, 26. Lower support ring 58 is preferably completely embedded in lower end 64. Similar to reinforcement rings 24, 26, support rings 56, 58 provide structural rigidity to ends 62, 64 of gripper element 54. Thus, the nominal diameter of gripper element 54 remains essentially constant in the vicinity of support rings 56, 58. The diameter may vary, however along the more central portion of gripper element 54.

Cylindrical wall 60 of gripper element 54 has a radially inner surface 68 and a radially outer surface 70. In its natural state, outer surface 70 has a constant diameter, just less than the nominal inner diameter of bladder 22. Inner surface 68 of gripper element 54 is cylindrically symmetric, but has a variable diameter, even when wall 60 is in its natural state. Tracing the profile of inner surface 68, beginning just radially inside of upper support ring 56 on upper end 62, inner surface 68 tapers radially inward and downward some distance until it reaches an upper transition point 72, preferably downward approximately one-third of the total length of gripper element 54. From upper transition point 72, the profile of inner surface 68 extends as a cylinder further downward until it reaches a lower transition point 74, approximately two-thirds down the total length of gripper element 54. From lower transition point 74, the profile of inner surface 68 extends radially outward and downward until it reaches lower end 64 of gripper element 54. Preferably, the taper angles at upper and lower transition points 72, 74 are equal, but they could differ. A bottom surface 76 of gripper element 54 is annular and extends from inner surface 68 to outer surface 70 at lower end 64.

Gripper body assembly 20 fits concentrically within bladder assembly 18. The length of gripper body assembly 20 in the axial direction, however, is less than the corresponding length of bladder assembly 18, when both are at their natural lengths. When uppermost surface 44 of upper retention ring 28 of bladder assembly 18 and the uppermost part of upper end 62 of gripper element 54 are aligned, bottom surface 76 of gripper element 54 approximately aligns with lower end 36 of bladder 22. That is, in the embodiment shown in FIG. 1A, gripper body assembly 20 is shorter than bladder assembly 18 by approximately the thickness of lower retention ring 30.

Gripper body assembly 20 attaches to a torque plate 78 (FIGS. 1A and 5). Torque plate 78 is an annular member having some thickness and countersink holes 80 therethrough. Bolts 82 pass freely through countersink holes 80 until each cap 84 of bolts 82 abuts a shoulder 86 of countersink holes 80. Bolts 82 engage threaded holes 66, and tightening of the threaded connection pulls torque plate 78 and gripper body assembly 20 into secure abutment.

Rotating cartridge subassembly 13 further comprises an upper housing 88 and a lower housing 90 (FIG. 1A). Upper housing 88 is a cylindrically symmetric shell having different diameter sections. An upper section 92 of upper housing 88 has an inner diameter $d_1$ equal to the nominal diameter of the central axial opening of drilling system subassembly 10: that is, a diameter just large enough to accommodate drillstring 14, including its joints or collars. A lower section 96 of upper housing 88 has an enlarged inner diameter $d_2$ that is significantly larger than inner diameter $d_1$. Upper section 92 transitions abruptly into lower section 96, producing an upper ledge 100.

Lower housing 90 is also a cylindrically symmetric shell having different diameter sections. An upper section 102 of lower housing 90 has an inner diameter $d_3$ just large enough to accommodate bladder assembly 18. Upper section 102 of lower housing 90 has an outer diameter $d_4$ just less than inner diameter $d_2$ of upper housing 88. A lower section 108 of lower housing 90 has a first inner diameter $d_5$, a second inner diameter $d_6$, a first ledge 114, and a second ledge 116. Viewing lower housing 90 in a downward direction, its inner diameters $d_3$, $d_5$, $d_6$ transition abruptly radially inward, forming ledges 114, 116, respectively.

The portion of lower housing 90 extending downward from ledge 116, having inner diameter $d_6$, abuts and attaches to an outer surface of a sleeve 118. Sleeve 118 extends from just below gripper 15 down to a stripper assembly 119 (FIG. 1B). The uppermost end of sleeve 118 is at the same relative height as first ledge 114. The inner diameter of sleeve 118 defines the nominal diameter of the central axial opening of drilling system subassembly 10.

First and second rings 120, 122, respectively, are complementary rings that fit together to fill the space between the portion of lower housing 90 extending downward from first ledge 114 to the height of second ledge 116 and the outer surface of sleeve 118. First ledge 114, an upper surface of first ring 120, and the uppermost end of sleeve 118 are coplanar.

When gripper 15 is assembled, gripper body assembly 20 is nested inside bladder assembly 18, as described above. Torque plate 78 sits atop surface 44 of upper retention ring 28, suspending gripper body assembly 20 inside bladder assembly 18. Torque plate 78 fastens to upper section 102 of lower housing 90 using conventional means such as pins, through which torque can be transmitted. Bladder 18 locates within lower housing 90, with its seals 52 (FIG. 3) sealing against the inner surface of lower housing 90.

A portion of upper section 102 of lower housing 90 fits concentrically within lower section 96 of upper housing 88. As stated above, the uppermost, annular surface of lower housing 90 and the upper surface of torque plate 78 are coplanar and in abutting contact with upper ledge 100 of upper housing 88. Gripper 15 is concentrically placed within lower housing 90. Lower retention ring 30 of bladder assembly 18 sits atop and occupies all of first ledge 114 of lower housing 90. Thus, gripper 15 is constrained between upper housing 88 and lower housing 90. Because gripper body assembly 20 is shorter than bladder assembly 18, as described above, there is a gap 124 between the bottom surface 76 of gripper element 54 and the upper surface of first ring 120.

Figure 6:
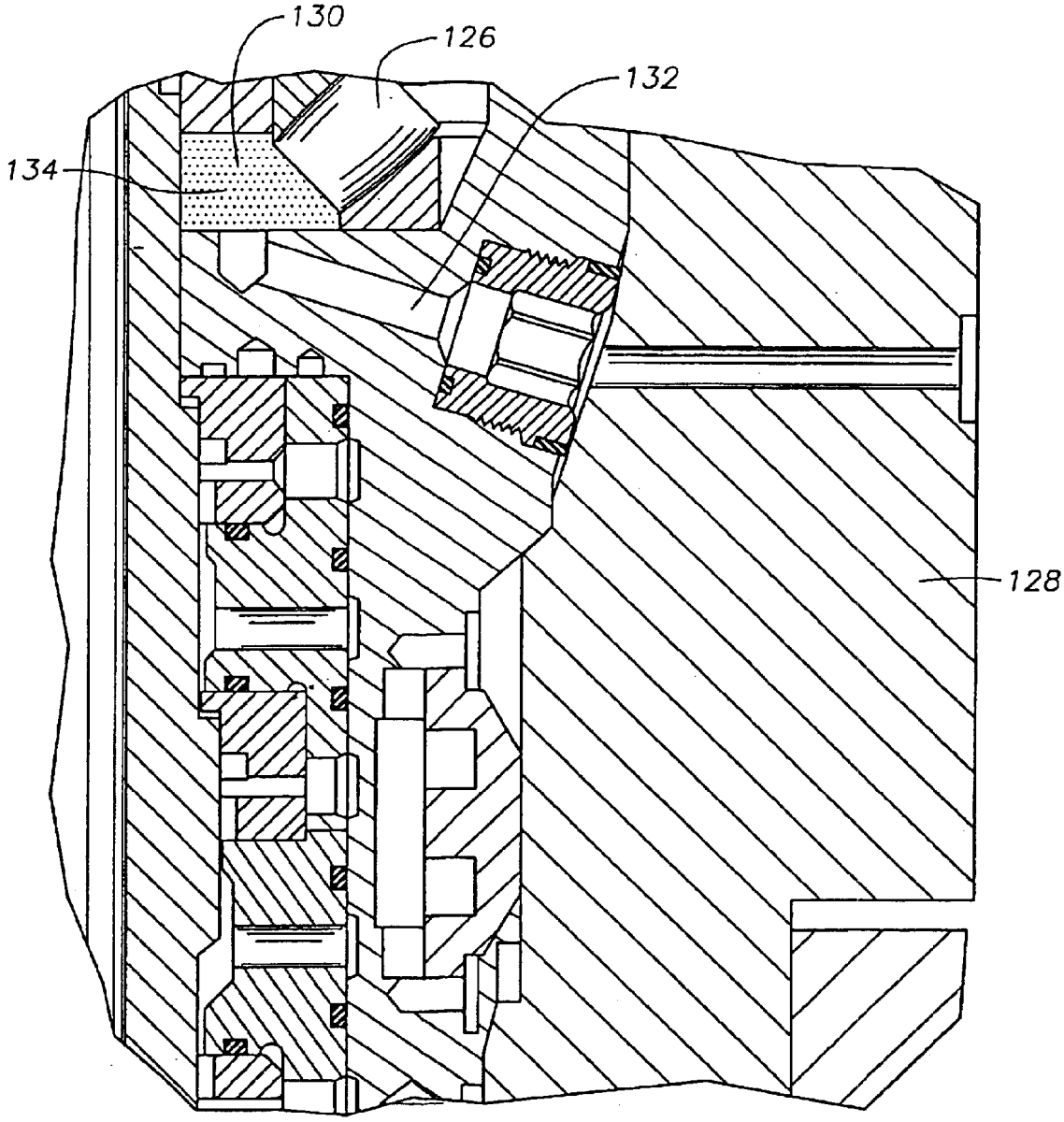
FIG. 6 is an enlarged sectional view of a detailed portion of the rotating drilling system subassembly of FIG. 1A showing the input tubing for the control fluid circulated around the bladder assembly of FIG. 1A.

Upper housing 88 and lower housing 90 are themselves constrained by bearings 126. Bearings 126 allow rotating cartridge assembly 13 to rotate relative to stationary structure 11. Stationary structure 11 surrounds cartridge assembly 13, forming a sealed cavity 130 between stationary structure 11 and rotating cartridge assembly 13. FIG. 6 shows an inlet tube 132 through which a control fluid 134 can enter cavity 130. Upper section 102 of lower housing 90 has ports 136 to allow fluid communication of control fluid 134 through lower housing 90. An outlet tube 138 (FIG. 1B) allows control fluid 134 to be circulated.

In operation, drillstring 14 is passed through the central axial opening of drilling system subassembly 10. Drillstring 14 is driven to rotate about the central axis and caused to move up and down. Rotating cartridge assembly 13 is designed to rotate with drillstring 14, but not translate. Cartridge assembly 13 is not separately driven, but is instead caused to rotate when gripper 15 grips rotating drillstring 14.

To cause the gripping to occur, control fluid 134 is injected under pressure through inlet tube 132 into cavity 130. Control fluid 134 passes through ports 136, bearing on the outer surface of wall 32 of bladder assembly 18. Seals 52 stop the upward and downward travel of control fluid 134, restricting the application of control fluid 134 onto bladder 22. However, seals 52 are free to slide on the inner wall of lower housing 90, thus bladder 22 is free to contract in length as it undergoes pressure. Bladder 22, in response to the pressure of control fluid 134, deforms into the outer surface of wall 60 of gripper body assembly 20, thereby transferring the pressure from control fluid 134 to gripper element 54. Gripper element 54 responds to that pressure by pressing harder onto drillstring 14, thereby increasing the normal force between gripper element 54 and drillstring 14 and both sealing and gripping drillstring 14.

Gripper element 54, being deformable, flattens out somewhat against drillstring 14, increasing the surface area of gripper element 54 in contact with drillstring 14. The increased surface area and increased normal force both serve to increase the frictional (gripping) force between gripper element 54 and drillstring 14. Thus, the gripping force can be varied by varying the pressure of control fluid 134. Outlet tube 138 provides a return path for control fluid 134. In this way, gripper 15 grips drillstring 14 with a variable, controllable gripping force such that gripper 15 can either hold drillstring 14 in place or it can allow drillstring 14 to move up or down in the axial direction, regardless of the rotation of drillstring 14.

The radial inward pressure of bladder 18 causes gripper element 54 to elongate. To prevent excessive deformation into the central axial opening of drilling system subassembly 10, gripper element 54 is also allowed to deform axially into gap 124. This allows some of the stress in gripper element 54 to be relieved by strain in the axial direction. This helps to prevent clipping or lopping off an expanded portion of gripper element 54 as drillstring 14 translates up or down. This is particularly a potential problem when the larger diameter collars, that is, where the individual sections of drillstring 14 join, pass gripper element 54. The tapered portions of inner surface 68 also help in that regard. Rings 120 and 122 provide a stop to limit elongation, if necessary.

The present invention offers many advantages over the prior art. Placing gripper body assembly 20 inside bladder assembly 18 allows for the pre-assembly of grippers 12 having variously sized gripper assemblies 20 and bladder assemblies 18 to accommodate different drilling environments. It allows for regulating the amount of gripping force by controlling fluid pressure and surface area exposed to that pressure. Grippers 12 can be optimally sized to accommodate expected drilling loads. Different elastomers can be used to produce desired deformations. The useful lifetime of gripper element 54 is increased by incorporating a gap 124, thereby reducing the extent to which gripping element 54 deforms into the region where it is likely to be lopped off or torn by the passing drillstring 14 or collar.

While the invention has been particularly shown and described with reference to a preferred and alternative embodiments, it will be understood by those skilled in the art that various changes in form and detail may be made therein without departing from the spirit and scope of the invention.

We claim:

1. An apparatus for sealing around drill pipe while the drill pipe is rotating, comprising:

an outer housing;

an inner housing rotatably mounted in the outer housing about an axis of rotation;

an annular bladder mounted in the inner housing;

an annular resilient member mounted in the bladder;

the inner housing having a passage for delivering hydraulic fluid pressure to an outer surface of the bladder to cause the bladder to deform inwardly, thereby forcing the resilient member to deform inwardly to grip and rotate with a drill pipe;

the resilient member having a first end secured to the inner housing for rotating the inner housing as the drill pipe rotates and a second end that is free to move axially in response to the deformation against the drill pipe; and a shoulder in the inner housing, the shoulder being spaced from the second end of the resilient member by a gap while the resilient member is in an undeformed condition, the shoulder providing a stop to limit elongation of the resilient member while being deformed by the bladder.

2. An apparatus for sealing around drill pipe while drilling, comprising:

an outer housing;

an inner housing rotatably mounted in the outer housing about an axis of rotation;

an annular bladder mounted in the inner housing, the bladder having a wall with an inner surface and an outer surface;

an annular elastomeric gripping member mounted in the bladder, the gripping member having an outer side in engagement with the inner surface of the bladder, the gripping member having an inner side for gripping and sealing around a drill pipe;

the inner housing having a passage for delivering hydraulic fluid pressure to the outer surface of the bladder to cause the bladder to deform inwardly, thereby forcing the gripping member to deform inwardly to grip and rotate with a drill pipe;

the gripping member having a first end secured to the inner housing for rotating the inner housing as the drill pipe rotates and a second end that is free to move axially to allow the bladder to elongate in response to the deformation by the bladder; and a rigid reinforcing ring mounted to the gripping member adjacent the second end.

3. The apparatus according to claim 2, wherein the reinforcing ring is embedded within the gripping member and located radially outward from the inner side of the gripping member.

4. The apparatus according to claim 2, further comprising a second rigid reinforcing ring mounted to the gripping member adjacent the second end.

5. The apparatus according to claim 2, further comprising:

a shoulder in the inner housing, the shoulder being spaced from the second end of the gripping member by a gap while the gripping member is in an undeformed condition, the shoulder providing a stop to limit elongation of the gripping member while being deformed by the bladder.

6. The apparatus according to claim 2, further comprising:

a rigid seal ring mounted to at least one end of the bladder;

a seal on an outer diameter of the seal ring that slidably engages an inner wall of the inner housing, enabling the bladder to contract in length when deformed by the hydraulic pressure.

7. The apparatus according to claim 2, further comprising:

upper and lower rigid rings mounted at upper and lower ends of the bladder, respectively;

a seal on an outer diameter of each of the rings, the seals slidably engaging an inner wall of the inner housing, enabling the bladder to contract in length when deformed by the hydraulic pressure.

8. A method for sealing around drill pipe while drilling, comprising:

(a) rotatably mounting an inner housing within an outer housing;

(b) mounting an annular bladder and an annular elastomeric gripping member within the bladder, securing a first end of the gripping member to the inner housing;

(c) stationarily mounting the outer housing to a rig floor and passing the drill pine through the gripping member;

(d) delivering hydraulic fluid pressure to an outer surface of the bladder to cause the bladder to deform inwardly, thereby forcing the gripping member to deform inwardly to grip and rotate with a drill pipe, and allowing the second end of the gripping member to move axially in response to the deformation against the drill pipe by the bladder; wherein step (b) further comprises:

providing a shoulder in the inner housing that is spaced from the second end of the gripping member by a gap while the gripping member is in an undeformed condition; and step (d) further comprises:

contacting the stop with the second end of the bladder to limit the deformation of the gripping member.

* * * * *